US010724510B2

(12) United States Patent
Fleischman

(10) Patent No.: US 10,724,510 B2
(45) Date of Patent: Jul. 28, 2020

(54) APPARATUS AND METHOD FOR GAS COMPRESSION

(71) Applicant: Scott Daniel Fleischman, Tallahassee, FL (US)

(72) Inventor: Scott Daniel Fleischman, Tallahassee, FL (US)

( * ) Notice: Subject to any disclaimer, the term of this patent is extended or adjusted under 35 U.S.C. 154(b) by 155 days.

(21) Appl. No.: 16/122,854

(22) Filed: Sep. 5, 2018

(65) Prior Publication Data

US 2019/0032650 A1 Jan. 31, 2019

Related U.S. Application Data

(63) Continuation-in-part of application No. 15/142,987, filed on Apr. 29, 2016, now abandoned.

(51) Int. Cl.

| | |
|---|---|
| ***F04B 39/00*** | (2006.01) |
| ***F04B 39/08*** | (2006.01) |
| ***F04B 39/06*** | (2006.01) |
| ***F04B 39/12*** | (2006.01) |
| ***F04B 51/00*** | (2006.01) |

(52) U.S. Cl.

CPC ..... *F04B 39/0055* (2013.01); *F04B 39/0027* (2013.01); *F04B 39/06* (2013.01); *F04B 39/08* (2013.01); *F04B 39/128* (2013.01); *F04B 51/00* (2013.01)

(58) Field of Classification Search

CPC .. F04B 39/0055; F04B 51/00; F04B 39/0027; F04B 39/06; F04B 39/08; F04B 39/128

See application file for complete search history.

(56) References Cited

U.S. PATENT DOCUMENTS

| | | | | |
|---|---|---|---|---|
| 2,937,715 | A * | 5/1960 | Jackson | F04B 39/0246 184/6.5 |
| 3,300,997 | A * | 1/1967 | Kocher | F25B 31/00 62/117 |
| 4,549,856 | A * | 10/1985 | Cash | F04C 28/24 417/295 |
| 5,515,769 | A * | 5/1996 | Basinski | F04B 39/04 417/420 |
| 5,611,845 | A * | 3/1997 | Delp, II | B01D 53/22 96/10 |
| 7,571,719 | B2 * | 8/2009 | Richardson | F01M 13/022 123/3 |
| 8,109,259 | B2 * | 2/2012 | Ulrey | F02M 25/089 123/519 |
| 9,382,825 | B2 * | 7/2016 | Pursifull | F01M 13/022 |
| 2007/0267003 | A1 * | 11/2007 | Sumser | F01M 13/021 123/572 |
| 2015/0322937 | A1 * | 11/2015 | Hritz | F04B 39/0094 417/53 |

* cited by examiner

*Primary Examiner* — Michael C Zarroli

(74) *Attorney, Agent, or Firm* — Wright Law Group, PLLC; Mark F. Wright

(57) ABSTRACT

An apparatus and method for substantially reducing or eliminating the introduction of ambient air into an open-crankcase compressor is disclosed. The method employs a compressed gas recycle control loop to reduce the magnitude of vacuum inside the open-crankcase compressor relative to ambient air pressure, thereby reducing or eliminating the introduction of ambient air into the open-crankcase compressor during the gas compression process.

18 Claims, 2 Drawing Sheets

APPARATUS AND METHOD FOR GAS COMPRESSION

BACKGROUND OF THE INVENTION

1. Technical Field

This invention relates generally to open crankcase reciprocating compressors and more specifically relates to an apparatus and method to reduce or eliminate contamination of compressed gas due to the introduction of ambient air.

2. Background Art

Maintaining the purity of gases during compression when using reciprocating compressors is a significant challenge in compression technology. The compressed gas can become contaminated with the lubricants used in the compressor, or by ambient gasses, commonly air, entering the compressor during the suction stroke of the compressor. These contaminations of the compressed gas can have a detrimental effect in certain applications where the purity of the compressed gas is critical.

To avoid the contamination problem, many manufacturers are offering piston compressors that do not require lubrication in the cylinders. These compressors are commonly referred to as ‘ oil-less’, ‘ oil-free’ or ‘ dry-running’. Where strict separation between the gas being compressed and ambient air is critical, complex and intricate compressor designs may be necessary. As no piston seal (or ring) can perfectly seal against the cylinder wall, some leakage into and out of the cylinder, is inevitable. To mitigate this vulnerability, additional barriers to gas escape and intrusion can be designed into the compressor. For example, labyrinth compressors will typically incorporate complex piston rod designs and multiple sealed chambers around the moving shafts. These designs can be very effective at maintaining the purity of compressed gas, but their intricate and precise designs come with a significantly higher acquisition cost.

Since many compressor applications are not sensitive to gas purity, compressor designs in which the piston seal is the only barrier between the compressed gas and ambient air are common. In some cases, there will be nothing more than a simple polymer seal between the piston and cylinder wall. These compressors have open crankcase designs that allow ambient air to circulate through the compressor crankcase so as to provide cooling to the compressor piston, cylinder, and the drive motor. These compressors typically operate at fairly low operating pressures, up to a few hundred psi, and are generally less than 15 hp. These compressors are often used for compressed air applications such as is common in an automotive repair shops. These compressors are very economical and reliable for applications that are not sensitive to the purity of the compressed gas.

As open-crankcase compressors age, the piston seals begin to leak, often within a few hundred hours of run time. Because of some specific design features of the piston seal, this leakage may not seriously affect the compressor performance with regards to outlet pressure and flow rate, however, it often leads to contamination of the compressed gas with ambient air. The compressor will begin to pull ambient air into the cylinder, from the crankcase, around the worn piston seals, during the suction stroke of the compression cycle. This ambient air then becomes part of the compressed gas. This piston seal leakage vulnerability has made these low-cost open-crankcase, oil-free, compressors, unsuitable for applications in which purity of the compressed gas is critical.

One common application requiring high purity compressed gas is on-demand industrial oxygen systems. Users of these systems include glassblowers and welders. These compressor systems generally employ pressure swing adsorption oxygen generators, which extract and purify oxygen from ambient air. The oxygen is delivered from the generator at fairly low pressure, usually 5-40 psi. This pressure is too low for many fuel gas/oxygen torches or for effective transport in a long manifold. Therefore, the oxygen is often compressed to a more usable pressure in the general range of 80 psi to 300 psi.

Many attempts to employ an open-crankcase piston compressor in this application have had limited success. The oxygen produced by the generator is usually 90% to 95% oxygen. When the oxygen is compressed in an open crankcase piston compressor, it can become diluted with ambient air. Commercial systems using this type of compressor often suffer significant oxygen purity loss (10-20%) across the compression stage.

The oxygen produced by the generator is usually 90% to 95% oxygen with a fixed flow rate. The flow rate capacity of a typical open-crankcase piston compressor is sensitive to the backpressure of downstream processes. For example, a compressor capable of compressing 90 liters per minute to 15 psi, may only be able to compress 30 liters per minute to 100 psi. This variable compressor capacity makes it virtually impossible to properly match the oxygen generator and compressor flow rates.

When the compressor capacity is less than the generator flow rate, the compressor intake pressure will rise, and may eventually overload the compressor. This can cause the compressor drive motor to overheat and stall. Pressure relief devices can be installed on the compressor inlet to avoid overloading the compressor. This type of protection wastes the excess oxygen.

When the compressor capacity is greater than the generator flow rate, the compressor intake pressure will drop. Thermodynamic principles dictate that lowering the inlet pressure will cause a dramatic rise in the compressor outlet gas temperature. The elevated temperature in the compressor can increase the piston seal wear and may accelerate the onset of leakage around the piston. Once the piston seal efficiency has been compromised, the higher pressure of the ambient air relative to the pressure in the cylinder during the suction stroke will force ambient air past the worn seals and into the cylinder, thereby contaminating the compressed air.

An oxygen system using an open-crankcase compressor as just described, can appear to be functioning properly in regards to pressure and flow rate, yet still exhibit a loss of oxygen purity of 15%-20% across the compression stage of the system. The performance of welding and glassblowing torches is seriously degraded by the use of low purity oxygen. Flame temperatures drop, and flame chemistry becomes more reducing, as the oxygen purity drops. At oxygen purity levels of 80% or less, the flame is nearly un-useable for many applications.

Because of these shortcomings, even though they are economical, most typical oil-less open-crankcase compressors are not well suited to applications that may be sensitive to the compressed gas purity. There are also many other applications that are sensitive to compressed gas purity including medical oxygen systems and inert gas systems. Accordingly, without additional methods or equipment to address the issues of contamination for open-crankcase compressors, the availability of these inexpensive compressors will continue to be sub-optimal.

BRIEF SUMMARY OF THE INVENTION

An apparatus and method for substantially reducing or eliminating the introduction of ambient air into an open-crankcase compressor is disclosed. The method employs a compressed gas recycle control loop to reduce the magnitude of vacuum inside the open-crankcase compressor relative to ambient air pressure, thereby reducing or eliminating the introduction of ambient air into the open-crankcase compressor during the compression process. Accordingly, this invention solves many of the problems that are encountered by using an oil-less open-crankcase piston compressor to produce high purity gases.

BRIEF SUMMARY OF THE FIGURES

The various preferred embodiments of the present invention will hereinafter be described in conjunction with the appended drawings, wherein like designations denote like elements, and.

DETAILED DESCRIPTION OF THE INVENTION

This invention enables economical oil-less open-crankcase piston compressors to perform in purity sensitive applications that until now, required the use of more complex, more expensive compressor designs.

This invention reduces or eliminates, a vacuum condition from developing at the intake of the oil-less open-crankcase piston compressor.

This invention greatly reduces the gas temperature rise through the oil-less open-crankcase piston compressor, resulting in increased service life.

This invention prevents ambient air from entering the oil-less open-crankcase piston compressor during the suction stroke, allowing the compressor to function properly even as the piston seals age and wear.

Figure 1:
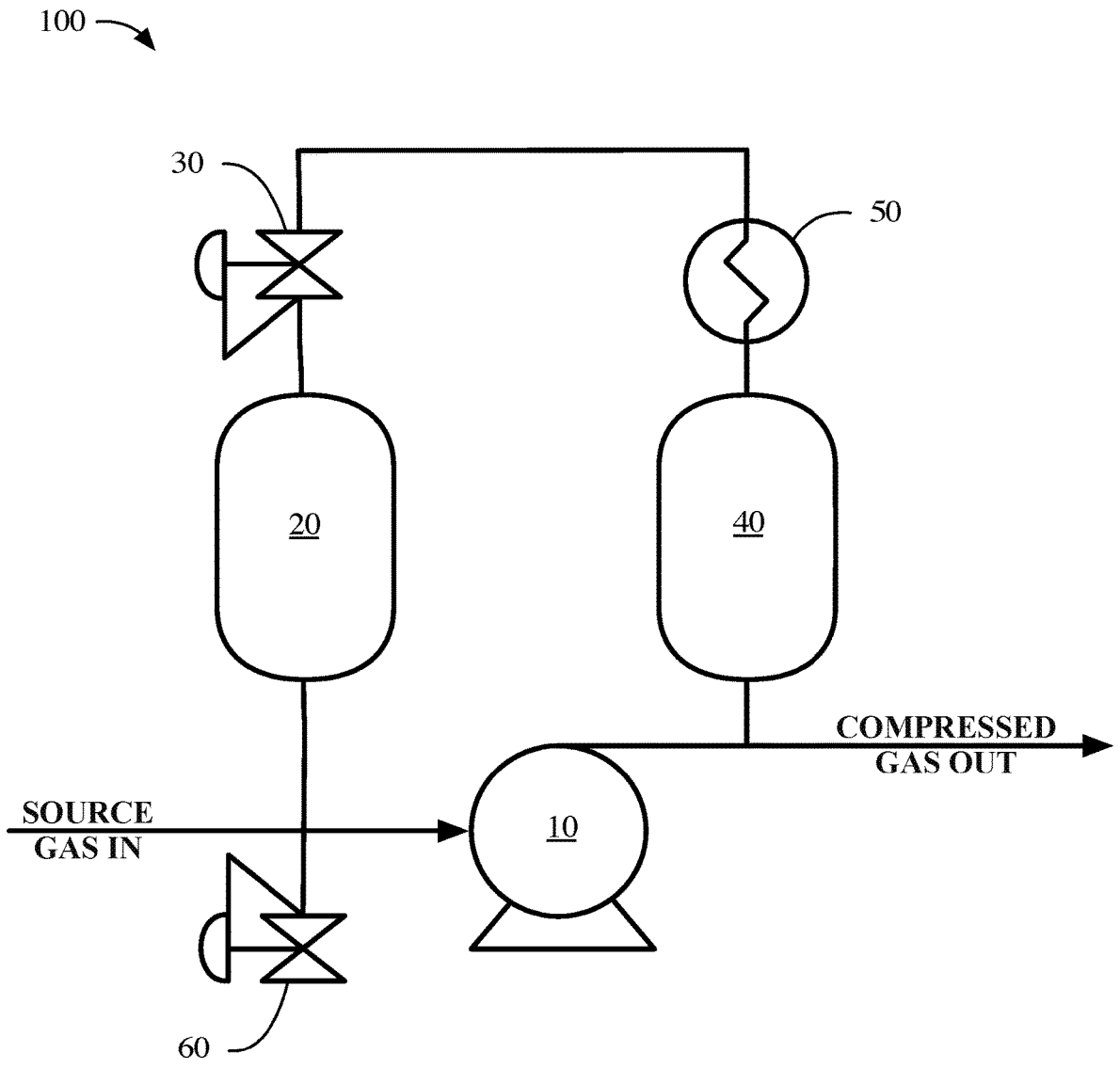
FIG. 1 is a block diagram of an apparatus for compressing air in accordance with a preferred exemplary embodiment of the present invention.

Referring now to FIG. 1, a schematic diagram of an apparatus 100 used to compress gas in accordance with a preferred exemplary embodiment of the present invention is depicted. The outlet of Compressor 10 is connected to a High Pressure Pulsation Dampener 40. High Pressure Pulsation Dampener 40 is connected to a Heat Exchanger 50. Heat Exchanger 50 is connected to a Pressure Regulator 30. Pressure Regulator 30 is connected to a Low Pressure Pulsation Dampener 20. Low Pressure Pulsation Dampener 20 is connected to the inlet of Compressor 10. Inlet Pressure Relief Valve 60 is connected to the inlet of Compressor 10.

Compressor 10 is most preferably an oil-less open-crankcase compressor.

Low Pressure Pulsation Dampener 20 is a volume bottle.

Pressure Regulator 30 is a pressure regulator.

Heat Exchanger 50 is heat exchanger.

High Pressure Pulsation Dampener 40 is a volume bottle.

Pressure Relief Valve 60 is a pressure relief valve.

In the most preferred embodiments of the present invention, Compressor 10 is an open-crankcase oil-less reciprocating (piston) compressor. In operation, it receives gas at its inlet, and compresses the gas to a higher pressure produced at its outlet. Compressor 10, by its design and implementation, will typically generate pressure fluctuations at both its inlet and outlet. These pressure fluctuations correspond to the stroke of each piston.

High Pressure Pulsation Dampener 40 and Low Pressure Pulsation Dampener 20 are most preferably volume bottles used to dampen the pressure fluctuations created by Compressor 10. A volume bottle is a pressure vessel usually three to ten times the swept volume of a compressor cylinder. The compressed gas in the volume bottle absorbs and dampens the pressure fluctuations generated by Compressor 10. Dampening the pressure fluctuations is necessary to prevent damage to, and allow proper function of, Pressure Regulator 30.

Pressure Regulator 30 is most preferably a common mechanical pressure regulator. Its function is to control pressure on the low-pressure side of Compressor 10. When the Pressure Regulator 30 senses a pressure on the low-pressure side of Compressor 10, that is below the setpoint for Pressure Regulator 30, Pressure Regulator 30 opens its internal control valve and allows gas to flow from the high pressure side to the low pressure side of Compressor 10. When the pressure on the low side Compressor 10 rises back to the setpoint for Pressure Regulator 30, the control valve inside Pressure Regulator 30 will begin to close. In this manner, Pressure Regulator 30 controls the pressure on the low-pressure side of Compressor 10 and prevents a vacuum from forming relative to the inlet of Compressor 10.

Heat Exchanger 50 is most preferably a finned tube heat exchanger. The temperature of the gas introduced into Compressor 10 will rise as it is compressed in the Compressor 10. Heat Exchanger 50 will dissipate or transfer the excess heat from the compressed gas to the ambient air through its fins. This is a typical process to prevent excessive heat buildup in the compression system.

Pressure Relief Valve 60 is most preferably a mechanical pressure relief valve. It is configured to monitor the gas pressure at the inlet to Compressor 10, and if the pressure exceeds the Pressure Relief Valve 60 setpoint, Pressure Relief Valve 60 will open and release the excess gas into the ambient environment. Once the pressure at the inlet of Compressor 10 falls below the set point for Pressure Relief Valve 60, Pressure Relief Valve 60 will close.

The path from the outlet of Compressor 10, through High Pressure Pulsation Dampener 40, through Heat Exchanger 50, through Pressure Regulator 30, through Low Pressure Pulsation Dampener 20 and to the inlet of Compressor 10, forms a recycle loop. Depending on the relative pressure at the inlet, high pressure compressed gas from the outlet of Compressor 10, is allowed to flow through this recycle loop, back to inlet of the Compressor 10. The gas flow in this recycle loop is controlled by Pressure Regulator 30. The setpoint for Pressure Regulator 30 is set so as to prevent the pressure at the inlet of Compressor 10 from dropping much lower than the pressure of the ambient air surrounding Compressor 10.

In summation, in the most preferred embodiments of the present invention, Compressor 10 compresses the gas while Heat Exchanger 50 is configured to remove excess heat from the compressed gas generated by Compressor 10. Low Pressure Pulsation Dampener 20 and High Pressure Pulsation Dampener 40, protect Pressure Regulator 30 from pressure fluctuations generated by Compressor 10. Pressure Regulator 30 controls the gas flow through the recycle loop to prevent excessively low pressure at the inlet to Compressor 10. Pressure Relief Valve 60 protects Compressor 10 from experiencing excessively high inlet pressure.

In at least one preferred embodiment of the present invention, Pressure Relief Valve 60 may be omitted. In this configuration, if the source gas is of insufficient flow rate to exceed the capacity of Compressor 10, Pressure Relief Valve 60 may not be necessary. Additionally, some commercially available Pressure Regulators 30 include some pressure relief capability.

Certain preferred embodiments of the present invention may omit either or both High Pressure Pulsation Dampener 40 and Low Pressure Pulsation Dampener 20. In certain applications, the function of a pulsation dampener may be accomplished by using a length of pipe or flexible tubing of sufficient volume to effectively dampen the pressure spikes created by the output of compressed gas from Compressor 10, thereby eliminating the need for a discrete pulsation dampener in the recycle loop.

Another embodiment of this invention may comprise a pulsation dampener design other than a volume bottle for High Pressure Pulsation Dampener 40 and Low Pressure Pulsation Dampener 20. Those skilled in the art will understand that there are a number of pulsation dampener designs that are commercially available, many of which are suitable for use in conjunction with the various preferred embodiments of the present invention.

Another preferred embodiment of the present invention may omit Heat Exchanger 50. Those skilled in the art will recognize that each of Compressor 10, High Pressure Pulsation Dampener 40, Low Pressure Pulsation Dampener 20 and the piping or tubing associated with recycle loop, all have some inherent heat exchange or heat dissipation capacity that may be sufficient to mitigate excessive heat buildup for certain applications.

Yet another preferred embodiment of the present invention might replace the finned tube Heat Exchanger 50, with another type heat exchanger. There are many commercially available heat exchanger designs that are suitable for use in conjunction with the various preferred embodiments of the present invention.

Another preferred embodiment of the present invention may replace Pressure Regulator 30 with another type of device that accomplishes the same function. There are many commercially available options that provide a combination of a discreet pressure sensor, discreet control valve. A programmable logic controller (PLC) is one example of a suitable substitute for Pressure Regulator 30.

Those skilled in the art will understand that additional embodiments of the present invention can be assembled using any number of combinations of these alternative components or elements.

Theory of Operation:

The intrusion of ambient air into the Compressor 10 requires both of two conditions: first, a path for the ambient air to flow through and second, a pressure differential of sufficient magnitude to push the ambient air through the available path into Compressor 10.

Compressor 10 piston seals inevitably wear out over time and will begin to leak, providing a path for the ambient air to flow into Compressor 10, thereby satisfying the first necessary condition for the intrusion of ambient air into Compressor 10.

The design of the apparatus and the associated method of the present invention greatly reduces or eliminates the development of the second necessary condition, a pressure differential of sufficient magnitude (e.g., a vacuum condition), needed to push the ambient air past the worn seals and into Compressor 10.

When Pressure Regulator 30 senses a vacuum condition at the inlet of Compressor 10, relative to the ambient air pressure, Pressure Regulator 30 allows a portion of the compressed gas from the outlet of Compressor 10 to flow back to the inlet of Compressor 10. This "recycled" compressed gas reduces the vacuum relative to the ambient air pressure at the inlet of Compressor 10 and, accordingly, prevents the intrusion of ambient air into Compressor 10.

Figure 2:
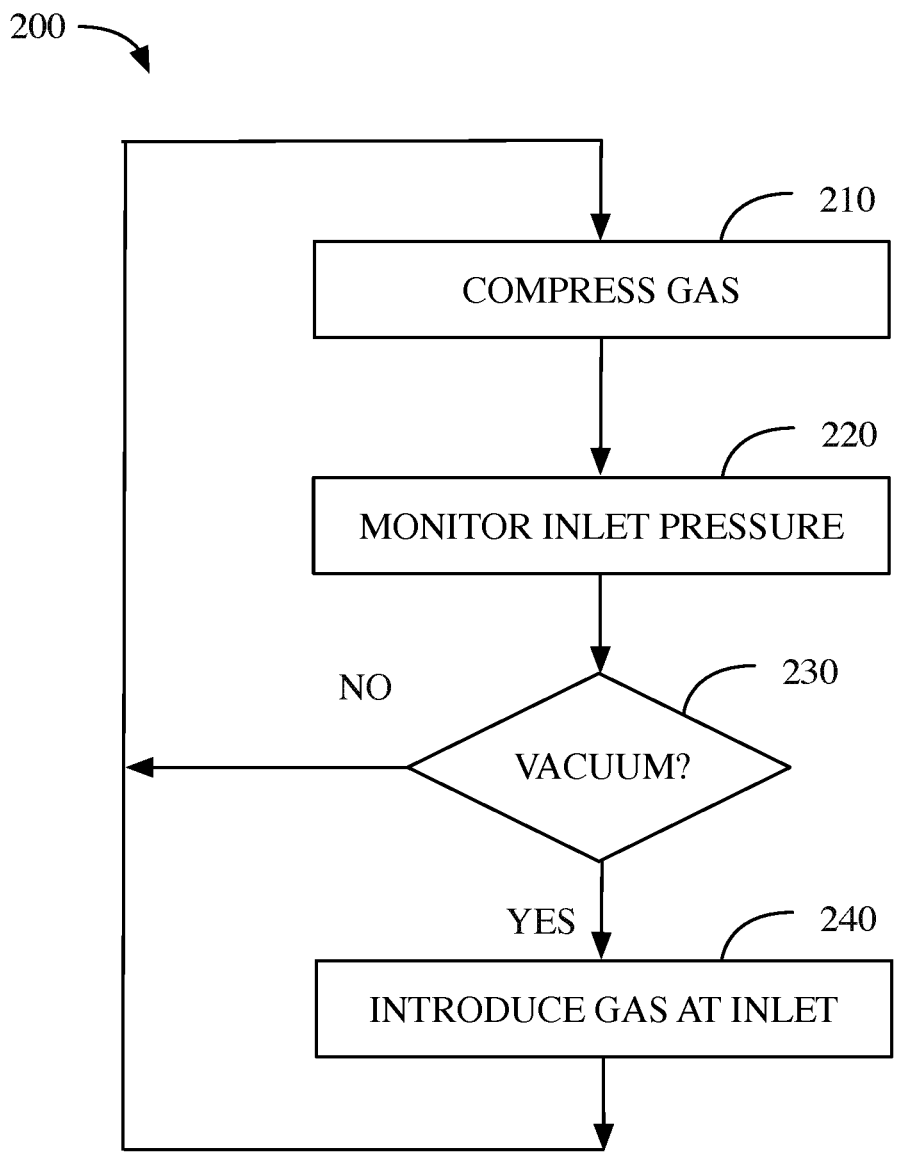
FIG. 2 is a flowchart of a method for compressing air in accordance with a preferred exemplary embodiment of the present invention.

Referring now to FIG. 2, a method 200 for compressing gas in accordance with a preferred embodiment of the present invention is depicted. As show in FIG. 2, a compressor is provided to compress gas (step 210) and the pressure at the inlet is monitored (step 220) to determine whether or not a vacuum is developing at the inlet (step 230). If a vacuum is detected (step 230="YES") then compressed gas from the compressor is delivered to the inlet (step 240) to deliver the. If a vacuum is not detected (step 240="NO") then the gas is continued to be compressed (step 210) and the inlet pressure is continually monitored (step 220).

Recycling compressed gas from the outlet of a compressor back to the inlet is referred to as "recycle" capacity control. Reciprocating compressors do not respond well to "choke" flow control. Simply restricting flow to a reciprocating compressor can cause excessive pressures and temperatures. Recycle capacity control allows the compressor to operate in harmony with upstream and downstream process demands while avoiding extremes in temperature and pressure. The primary goal of the most preferred embodiments of the present invention is not to alter the capacity of the compressor, but to prevent the intrusion of unwanted ambient air into the compressed gas by preventing the formation of a vacuum condition for the oil-less open-crankcase compressor. Accordingly, the gas compression system described by the various preferred embodiments of the present invention provides a highly reliable and economical device that can deliver compressed gas that is relatively free from contamination with ambient air.

In summary, it will be understood that even though certain aspects of the present specification are highlighted by referring to one or more specific embodiments, those skilled in the art will readily appreciate that these disclosed embodiments are only illustrative of the principles of the subject matter disclosed herein. Therefore, it should be understood that the disclosed subject matter is in no way limited to a particular methodology, protocol, and/or material, etc., described herein. As such, various modifications or changes to or alternative configurations of the disclosed subject matter can be made in accordance with the teachings herein without departing from the spirit of the present specification. Lastly, the terminology used herein is for the purpose of describing particular embodiments only, and is not intended to limit the scope of the present disclosure, which is defined solely by the claims. Accordingly, embodiments of the present disclosure are not limited to those precisely as shown and described.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, or term so qualified encompasses a reasonable range above and below the value of the stated characteristic, item, quantity, parameter, property, or term. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should be construed in light of the number of reported significant digits and by applying ordinary rounding techniques.

Notwithstanding that the numerical ranges and values setting forth the broad scope of the disclosure are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

The terms "a," "an," "the" and similar referents used in the context of describing the disclosed embodiments (especially in the context of the following claims) are to be construed to cover both the singular and the plural, unless otherwise indicated herein or clearly contradicted by context. All methods described herein can be performed in any suitable order unless otherwise indicated herein or otherwise clearly contradicted by context. The use of any and all examples, or exemplary language (e.g., "such as") provided herein is intended merely to better illuminate the present disclosure and does not pose a limitation on the scope of the embodiments otherwise claimed. No language in the present specification should be construed as indicating any non-claimed element essential to the practice of the disclosed embodiments.

It will also be understood by those skilled in the art that the specific concepts and principles set forth herein are broadly applicable to any compressed gas application, industrial or medical that may be sensitive to contamination of compressed gas by the introduction of ambient air. Nitrogen, argon, fuel gases, and carbon dioxide are examples gasses that are commonly used applications that are sensitive to contamination with ambient air. Accordingly, the scope of the invention should be determined not by the embodiment(s) illustrated, but by the appended claims and their legal equivalents.

The invention claimed is:

1. An apparatus comprising:

an oil-less open-crankcase compressor in an environment, the environment comprising a quantity of ambient air, the oil-less open-crankcase compressor comprising:
an inlet; and
an outlet;

a quantity of compressed gas produced by the oil-less open-crankcase compressor; and a recycle loop coupled to the outlet of the oil-less open-crankcase compressor and the inlet of the oil-less open-crankcase compressor, wherein the recycle loop is configured to control the flow of the quantity of compressed gas through the recycle loop so as to introduce at least a portion of the quantity of compressed gas produced by the oil-less open-crankcase compressor from the outlet of the oil-less open-crankcase compressor to the inlet of the oil-less open-crankcase compressor, thereby substantially inhibiting the creation of a vacuum at the inlet of oil-less open-crankcase compressor relative to the quantity of ambient air, thereby substantially eliminating the intrusion of the quantity of ambient air into the compressor.

2. The apparatus of claim 1 wherein the recycle loop further comprises a pulsation dampener coupled to the inlet of the oil-less open-crankcase compressor.

3. The apparatus of claim 1 wherein the recycle loop further comprises a pulsation dampener coupled to the outlet of the oil-less open-crankcase compressor.

4. The apparatus of claim 1 wherein the recycle loop further comprises:

a pulsation dampener coupled to the inlet of the oil-less open-crankcase compressor; and a pulsation dampener coupled to the outlet of the oil-less open-crankcase compressor.

5. The apparatus of claim 1 wherein the recycle loop further comprises a heat exchanger coupled between the inlet of the oil-less open-crankcase compressor and the outlet of the oil-less open-crankcase compressor.

6. The apparatus of claim 1 wherein the recycle loop further comprises:

a first pulsation dampener coupled to the inlet of the oil-less open-crankcase compressor;

a second pulsation dampener coupled to the outlet of the oil-less open-crankcase compressor; and a heat exchanger coupled between the first pulsation dampener and the second pulsation dampener.

7. The apparatus of claim 1 wherein the recycle loop further comprises a pressure regulator.

8. The apparatus of claim 1 wherein the recycle loop further comprises:

a first pulsation dampener coupled to the inlet of the oil-less open-crankcase compressor;

a second pulsation dampener coupled to the outlet of the oil-less open-crankcase compressor;

a heat exchanger coupled between the first pulsation dampener and the second pulsation dampener; and a pressure regulator coupled between the first pulsation dampener and the heat exchanger.

9. The apparatus of claim 1 wherein the recycle loop is configured to selectively deliver at least a portion of the quantity of compressed gas to the inlet when a vacuum condition is detected at the inlet and wherein the recycle loop is configured to selectively not deliver at least a portion of the quantity of compressed gas to the inlet when a vacuum condition is not detected at the inlet.

10. An apparatus for compressing air, the apparatus comprising:

an oil-less open-crankcase compressor producing a quantity of compressed gas, the oil-less open-crankcase compressor comprising an inlet and an outlet;

a pressure relief valve coupled to the inlet;

a gas source coupled to the pressure relief valve; and a recycle loop configured to recycle at least a portion of the quantity of compressed gas by supplying at least a portion of the quantity of compressed gas to the inlet of the oil-less open-crankcase compressor, depending on a pressure sensed at the inlet, the recycle loop comprising:
a first volume bottle coupled to the outlet;
a heat exchanger coupled to the first volume bottle;
a pressure regulator coupled to the heat exchanger; and
a second volume bottle coupled to the pressure regulator and to the inlet.

11. A method of reducing the intrusion of ambient air into an oil-less open-crankcase compressor comprising the steps of:

using the oil-less open-crankcase compressor to compress a quantify of gas;

monitoring an ambient air pressure at an inlet for the oil-less open-crankcase compressor; and delivering at least a portion of the compressed gas from an outlet of the oil-less open-crankcase compressor to the inlet whenever the ambient air pressure at the inlet drops below a pre-determined level.

12. The method of claim 11 wherein the step of delivering at least a portion of the compressed gas from the oil-less open-crankcase compressor to the inlet whenever the ambient air pressure at the inlet drops below a pre-determined level comprises the step of using a recycle loop to deliver at least a portion of the compressed gas from the oil-less open-crankcase compressor to the inlet whenever the ambient air pressure at the inlet drops below a pre-determined level.

13. The method of claim 12 wherein the recycle loop further comprises:

a pulsation dampener coupled to the inlet of the oil-less open-crankcase compressor; and a pulsation dampener coupled to the outlet of the oil-less open-crankcase compressor.

14. The method of claim 12 wherein the recycle loop further comprises a heat exchanger coupled between the inlet of the oil-less open-crankcase compressor and the outlet of the oil-less open-crankcase compressor.

15. The method of claim 12 wherein the recycle loop further comprises:

a first pulsation dampener coupled to the inlet of the oil-less open-crankcase compressor;

a second pulsation dampener coupled to the outlet of the oil-less open-crankcase compressor; and a heat exchanger coupled between the first pulsation dampener and the second pulsation dampener.

16. The method of claim 12 wherein the recycle loop further comprises:

a first pulsation dampener coupled to the inlet of the oil-less open-crankcase compressor;

a second pulsation dampener coupled to the outlet of the oil-less open-crankcase compressor;

a heat exchanger coupled between the first pulsation dampener and the second pulsation dampener; and a pressure regulator coupled between the first pulsation dampener and the heat exchanger.

17. The method of claim 12 wherein the recycle loop is configured to selectively deliver at least a portion of the quantity of compressed gas to the inlet when a vacuum condition is detected at the inlet and wherein the recycle loop is configured to selectively not deliver at least a portion of the quantity of compressed gas to the inlet when a vacuum condition is not detected at the inlet.

18. The method of claim 11 further comprising the step of not delivering at least a portion of the compressed gas from an outlet of the oil-less open-crankcase compressor to the inlet whenever the ambient air pressure at the inlet rises above a pre-determined level.

* * * * *